US010808581B2

(12) United States Patent
Urakawa

(10) Patent No.: US 10,808,581 B2
(45) Date of Patent: Oct. 20, 2020

(54) VALVE TIMING CONTROL DEVICE FOR INTERNAL COMBUSTION ENGINE AND METHOD FOR ASSEMBLING VALVE TIMING CONTROL DEVICE

(71) Applicant: HITACHI AUTOMOTIVE SYSTEMS, LTD., Hitachinaka-shi, Ibaraki (JP)

(72) Inventor: Shinji Urakawa, Atsugi (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 0 days.

(21) Appl. No.: 16/318,668

(22) PCT Filed: Jul. 11, 2017

(86) PCT No.: PCT/JP2017/025197
§ 371 (c)(1),
(2) Date: Jan. 17, 2019

(87) PCT Pub. No.: WO2018/030056
PCT Pub. Date: Feb. 15, 2018

(65) Prior Publication Data

US 2019/0284968 A1 Sep. 19, 2019

(30) Foreign Application Priority Data

Aug. 10, 2016 (JP) ..... 2016-157207

(51) Int. Cl.
*F01L 1/344* (2006.01)
*F01L 13/08* (2006.01)
*F01L 1/356* (2006.01)

(52) U.S. Cl.
CPC ..... *F01L 1/3442* (2013.01); *F01L 1/344* (2013.01); *F01L 1/356* (2013.01); *F01L 13/08* (2013.01);

(Continued)

(58) Field of Classification Search
CPC ..... F01L 1/3442; F01L 13/08; F01L 2103/01; F01L 2001/34469; F01L 1/344; F01L 1/356

(Continued)

(56) References Cited

U.S. PATENT DOCUMENTS 7,503,298 B2 * 3/2009 Kinugawa ..... F01L 1/3442 123/90.15
8,776,741 B2 * 7/2014 Neal ..... F01L 1/26 123/90.17

(Continued)

FOREIGN PATENT DOCUMENTS

JP 2010-190144 A 9/2010
JP 2012-197777 A 10/2012

(Continued)

OTHER PUBLICATIONS

Office Action received in corresponding Japanese Patent Application No. 2018-532880 dated Jan. 7, 2020.

*Primary Examiner* — Patrick Hamo
*Assistant Examiner* — Wesley G Harris
(74) *Attorney, Agent, or Firm* — Foley & Lardner LLP

(57) ABSTRACT

A valve timing control device includes: a first clearance being formed between a radial other side of the outer circumference surface of the first shaft portion, and a confronting end surface of a radial other side of the inner circumference surface of the sliding hole, a second clearance being formed between an outer circumference of the second shaft portion on a side of the first clearance, and a radial other side of the inner circumference surface of the lock recessed portion, a stepped surface being formed at a connection portion between the first shaft portion and the second shaft portion, and having a stepped width in a radial (Continued)

direction, and a width of the second clearance being substantially identical to the width of the stepped surface.

13 Claims, 7 Drawing Sheets

(52) U.S. Cl.
CPC . *F01L 2001/34469* (2013.01); *F01L 2303/01* (2020.05)

(58) Field of Classification Search
USPC ..... 123/90.17, 90.15
See application file for complete search history.

(56) References Cited

U.S. PATENT DOCUMENTS

| | | | | |
|---|---|---|---|---|
| 10,371,019 | B2 | 8/2019 | Watanabe et al. | |
| 2003/0226256 | A1* | 12/2003 | Foster | B23P 19/042 29/888.01 |
| 2011/0253087 | A1* | 10/2011 | Ikeda | F01L 1/3442 123/90.17 |
| 2012/0017857 | A1* | 1/2012 | Kato | F01L 1/3442 123/90.15 |
| 2012/0318218 | A1 | 12/2012 | Kato et al. | |

FOREIGN PATENT DOCUMENTS

| | | | |
|---|---|---|---|
| JP | 2013-002373 | A | 1/2013 |
| JP | 2013-002418 | A | 1/2013 |
| WO | WO-2016/114019 | A1 | 7/2016 |

* cited by examiner

VALVE TIMING CONTROL DEVICE FOR INTERNAL COMBUSTION ENGINE AND METHOD FOR ASSEMBLING VALVE TIMING CONTROL DEVICE

TECHNICAL FIELD

This invention relates to a valve timing control device for an internal combustion engine arranged to control and vary opening and closing timings of an intake valve and an exhaust valve in accordance with a driving state, and to an assembling method for the valve timing control device.

BACKGROUND ART

In a valve timing control device for an internal combustion engine, it is necessary to adjust, with a high accuracy, a circumferential clearance between a lock hole and a lock pin which are arranged to restrict a relative rotation position of a vane rotor on a maximum advance angle side or a maximum retard angle side, with respect to a housing, for suppressing a generation of hammering noise (hitting noise, striking noise) between vanes of the vane rotor and shoes provided on an inner circumference surface of the housing, at an engine start and so on.

A valve timing control device described in a below patent document 1 includes a lock hole formed in a bottom wall of a housing; and a through hole penetrating through the bottom wall. This through hole is for visually inspecting a circumferential clearance between a lock pin and the lock hole at an assembling operation of constituting components. The clearance is adjusted by an eccentric bolt provided to one of the shoes. In this way, the clearance between the lock pin and the lock hole can be appropriately adjusted by the visual inspection from the through hole. Accordingly, it is possible to adjust the clearance with the high accuracy.

Besides, the through hole is closed by a cap inserted from an outside of the bottom wall after the adjustment of the clearance.

PRIOR ART DOCUMENT

Patent Document

Patent Document 1: Japanese Patent Application Publication No. 2013-2418

SUMMARY OF THE INVENTION

Problems which the Invention is Intended to Solve

However, in the conventional valve timing control device, the through hole is formed in the bottom wall of the housing for the visual inspection of the clearance between the lock pin and the lock hole. Moreover, the eccentric bolt is provided to the shoe for the fine adjustment of the clearance. Furthermore, the through hole is closed by the cap after the finish of the assembling operation. Accordingly, the number of the components is remarkably increased. Moreover, the adjustment operation of the clearance is complicated to deteriorate the working efficiency of the adjustment.

It is, therefore, an object of the present invention to provide a valve timing control device for an internal combustion engine which is devised to solve the above-described problems of the conventional valve timing control device, to suppress the increase of the number of the components, and the deterioration of the working efficiency of the clearance adjustment, due to the adjustment of the clearance between the lock pin and the lock hole.

Means for Solving the Problem

In the invention described in claim 1, a valve timing control device includes a lock pin which includes a first shaft portion on a sliding hole, a second shaft portion that is integrally provided to a tip end of the first shaft portion, and that has a diameter smaller than that of the first shaft portion, and a stepped surface formed between the first shaft portion and the second shaft portion, the second shaft portion having an axial length longer than a depth of the lock recessed portion from an opening edge of the lock recessed portion to an inner bottom surface of the lock recessed portion, a first clearance being formed between a radial other side of the outer circumference surface of the first shaft portion, and a confronting end surface of a radial other side of the inner circumference surface of the sliding hole, a second clearance being formed between an outer circumference of the second shaft portion on a side of the first clearance, and a radial other side of the inner circumference surface of the lock recessed portion, a stepped surface being formed at a connection portion between the first shaft portion and the second shaft portion, and having a stepped width in a radial direction, and a width of the second clearance being substantially identical to the width of the stepped surface.

Benefit of the Invention

By the present invention, it is possible to suppress the increase of the number of the components due to the adjustment of the clearance between the lock pin and the lock hole, and to improve the working efficiency of the adjustment of the clearance.

BRIEF DESCRIPTION OF DRAWINGS

FIG. 6A is a sectional view showing a state where a pin corresponding jig is inserted into a sliding hole and a lock hole. FIG. 6B is a sectional view showing a state where the vane rotor is relatively rotated in the maximum retard angle direction through the rear plate and the pin corresponding jig. FIG. 6C is a sectional view showing a state where the lock pin is inserted after the pin corresponding jig is pulled out. FIG. 6D is a sectional view showing a state where a tip end portion of the lock pin inserted into the sliding hole is inserted and engaged in the lock hole.

FIG. 7A is a sectional view showing a state where a pin corresponding jig is inserted into a sliding hole and a lock hole. FIG. 7B is a sectional view showing a state where the vane rotor is relatively rotated in the maximum retard angle direction through the rear plate and the pin corresponding jig. FIG. 7C is a sectional view showing a state where the lock pin is inserted after the pin corresponding jig is pulled out. FIG. 7D is a sectional view showing a state where a tip end portion of the lock pin inserted into the sliding hole is inserted and engaged in the lock hole.

DESCRIPTION OF EMBODIMENTS

Hereinafter, valve timing control devices for an internal combustion engine which are according to embodiments of the present invention, and which are applied to an intake valve side are explained with reference to the drawings.

Figure 1:
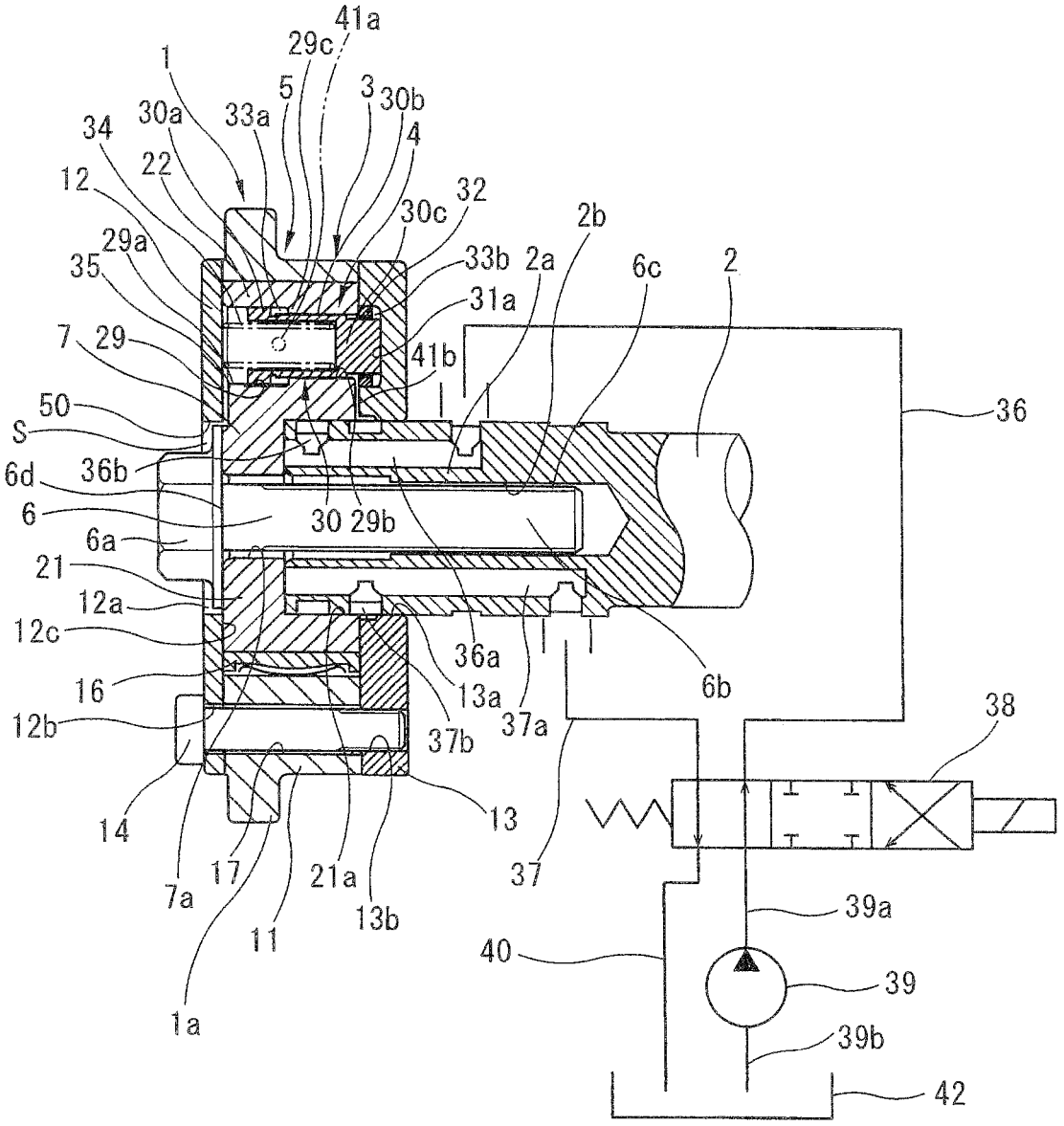
FIG. 1 is an overall configuration view which shows a valve timing control device according to the present invention, and which shows a section of a part of the valve timing control device.
Figure 2:
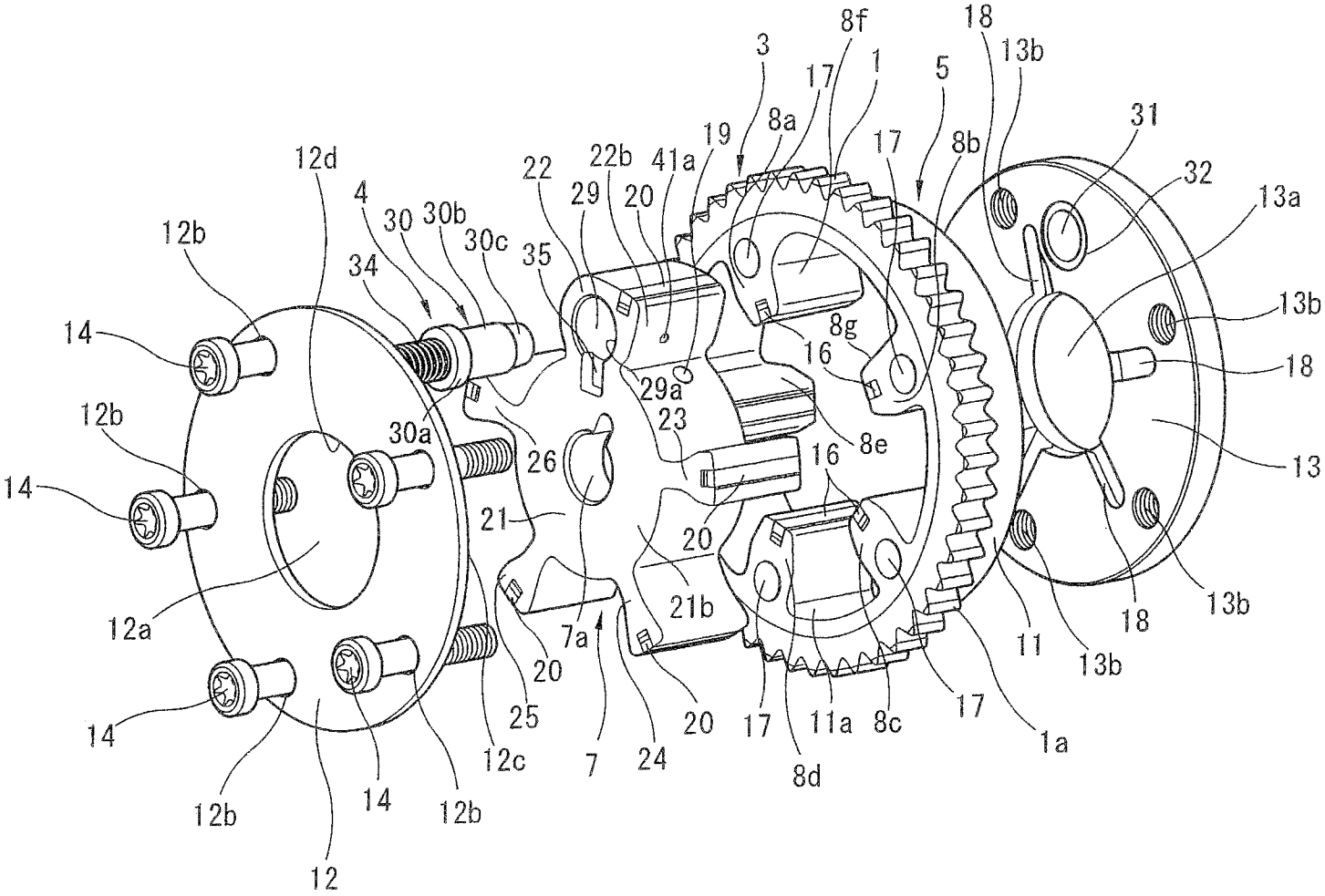
FIG. 2 is an exploded perspective view showing the valve timing control device according to embodiments.
Figure 3:
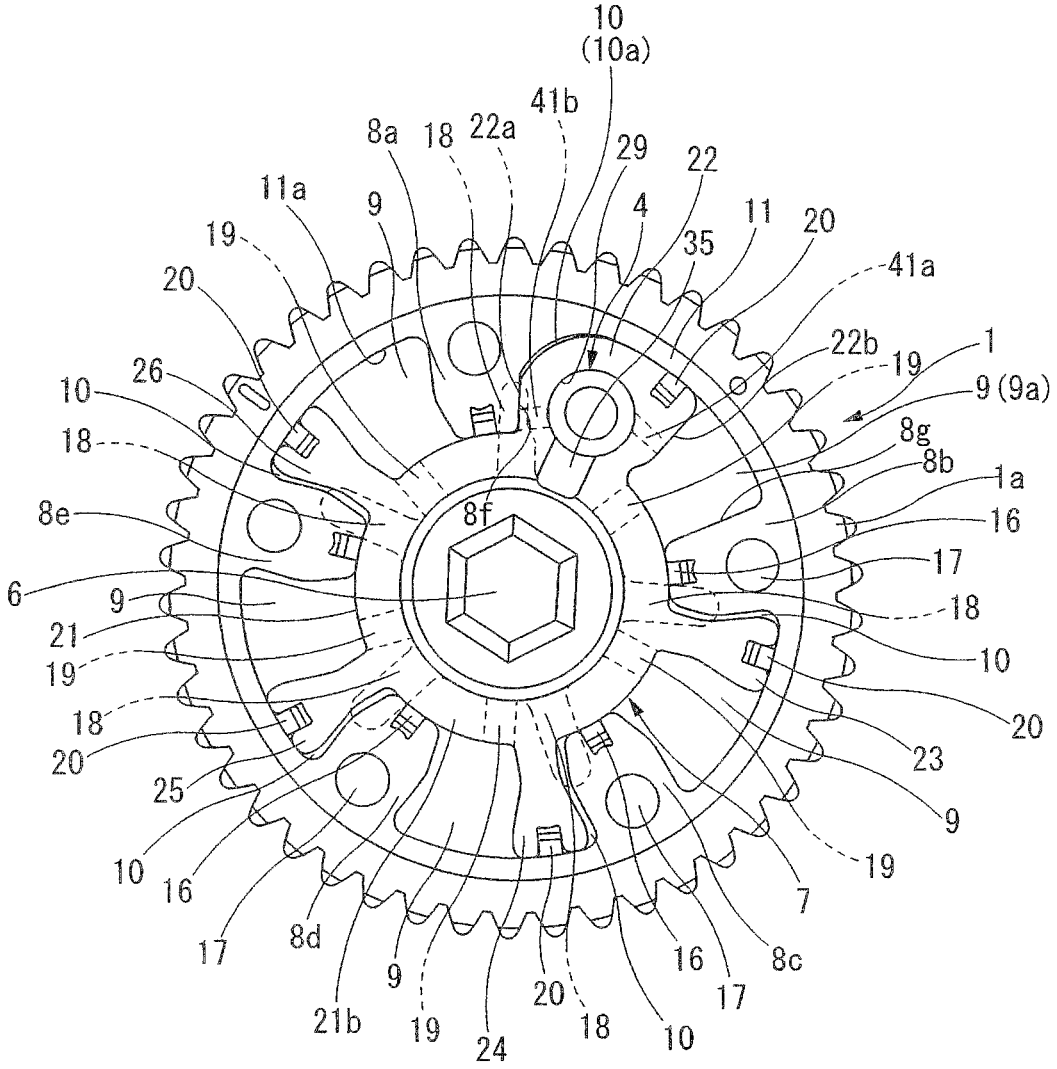
FIG. 3 is a front view showing a state in which a front plate is detached, and in which a vane rotor is relatively rotated to a maximum retard angle side.

As shown in FIG. 1 to FIG. 3, this valve timing control device includes a sprocket 1 arranged to be driven and rotated by a crank shaft (not shown) of the engine through a timing chain; a cam shaft 2 provided to be rotated relative to the sprocket 1; a phase varying mechanism 3 disposed between the sprocket 1 and the cam shaft 2, and arranged to vary (convert) the relative pivot phase between the sprocket 1 and the cam shaft 2; and a lock mechanism 4 arranged to lock an actuation of the phase varying mechanism 3.

The sprocket 1 includes a plurality of teeth portions 1*a* which are integrally formed on an outer circumference of a housing main body 11 (described later), and around which the timing chain (not show) is wound.

The cam shaft 2 is rotatably supported by a cylinder head (not shown) through cam bearings. The cam shaft 2 includes a plurality of drive cams which are integrally provided on an outer circumference surface of the cam shaft 2 at predetermined positions, and which are arranged to open intake valves (not shown) against spring forces of valve springs. Moreover, the cam shaft 2 includes an one end portion 2*a*; and an internal screw hole 2*b* which is formed within the one end portion 2*a* in an axial direction, and in which an external screw portion 6*b* formed on an outer circumference surface of a shaft portion 6*b* of a cam bolt 6 (described later) is screwed.

The cam bolt 6 includes a hexagonal head portion 6*a*; the shaft portion 6*b* integrally provided to one end portion of the head portion 6*a* through a flange-shaped seat portion 6*d*; and the external screw portion 6*c* formed on an outer circumference of a tip end portion of the shaft portion 6*b*.

The phase varying mechanism 3 includes a housing 5 disposed on a side of the one end portion 2*a* of the cam shaft 2; a vane rotor 7 which is fixed to the one end portion 2*a* of the cam shaft 2 by the cam bolt 6 from the axial direction, and which is rotatably received within the housing 5; first to fifth shoes 8*a* to 8*e* which are integrally formed within the housing 5, and which protrude from an inner circumference surface of the housing main body 11 (described later); five vanes 22 to 26 (described later) of the vane rotor 7; retard angle hydraulic chambers 9 which are five retard angle operation chambers, and which are separated by the first to fifth shoes 8*a* to 8*e* and the five vanes 22 to 26; advance angle hydraulic chambers 10 which are five advance angle operation chambers, and which are separated by the first to fifth shoes 8*a* to 8*e* and the five vanes 22 to 26; and a hydraulic circuit arranged to supply and discharge the hydraulic pressure to and from the retard angle hydraulic chambers 9 and the advance angle hydraulic chambers 10.

The housing 5 includes the housing main body 11 which has a substantially cylindrical shape having openings located on both ends in the axial direction; and a front plate 12 and a rear plate 13 which are plate members closing the front axial end opening and the rear axial end opening of the housing main body 11. In the housing 5, the front plate 12 and the rear plate 13 are integrally connected to the housing main body 11 by being tightened together by five bolts 14 from the axial direction.

Besides, for example, the housing main body 11 may have a bottomed cylindrical shape in which the front end opening is closed by a disc shaped bottom wall, and in which the only rear end opening is closed by the rear plate 13.

The housing main body 11 is integrally formed from sintered metal. The housing main body 11 includes the sprocket 1 integrally provided on the outer circumference of the front end side of the housing main body 11; and the first to fourth shoes 8*a* to Se which are integrally provided on the inner circumference of the housing main body 11 at a substantially regular interval in the circumferential direction, and which protrude inwards.

Each of the shoes 8*a* to 8*e* includes a seal groove which has a substantially U-shape when viewed from a side, and which is formed at a tip end portion of the each of the shoes 8*a* to 8*e* along the axial direction. A substantially U-shaped seal member 16 is mounted and fixed in the seal groove of the each of the shoes 8*a* to 8*e*. Moreover, each of the shoes 8*a* to 8*e* includes a bolt insertion hole 17 which is formed in the axial direction on a radially outer side of the each of the shoes 8*a* to 8*e*, that is, a base end portion side that is a connection portion between the each of the shoes 8*a* to 8*e* and the inner circumference surface is of the housing main body 11, which penetrates through the each of the shoes 8*a* to 8*e*, and through which the bolts 14 are inserted.

The front plate 12 is formed into a relatively thin circular plate shape by press-forming a metal plate. The front plate 12 includes an insertion hole 12*a* which is formed at a central portion, and into which the head portion 6*c* of the cam bolt 6 is inserted with a predetermined clearance; and five bolt holes 12*b* which are formed on the outer circumference side of the front plate 12 at a regular interval in the circumferential direction, and through which the bolts 14 are inserted.

The entire rear plate 13 is formed from a sintered alloy. The rear plate 13 includes a support hole 13*a* which is formed at a central portion, which penetrates through the rear plate 13, and through which the one end portion 2*a* of the cam shaft 2 is rotatably inserted; and five internal screw holes 13*b* which are formed on the outer circumference side of the rear plate 13 at a regular interval in the circumferential direction, which penetrate through the rear plate 13, and into which the tip end portions of the bolts 14 are screwed.

Moreover, the rear plate 13 includes five advance angle side oil grooves 18 which are formed on an inner end surface of the rear plate 13, which extend radially from a center of the support hole 13*a*, and which are connected, respectively, to the advance angle hydraulic chambers 10.

The vane rotor 7 is integrally formed from sintered metal. The vane rotor 7 includes a cylindrical rotor portion 21 which includes an insertion hole 7*a* formed is at a central portion of the vane rotor 7, and which is fixed to the one end portion 2*a* of the cam shaft 2 from the axial direction by the cam bolt 6 inserted into the insertion hole 7*a* in the axial direction; and the first to fifth vanes 22 to 26 which are formed on the outer circumference surface of the rotor portion 21 at a substantially regular interval in the circumferential direction, and which protrude from the outer circumference surface.

The rotor portion 21 is arranged to be rotated while the outer circumference surface of the rotor portion 21 is slidably moved on the seal members 16 mounted and fixed in the upper surfaces of the tip end portions of the shoes 8*a* to 8*e*. Moreover, as shown in FIG. 3, the rotor portion 21 includes five retard angle side oil holes 19 which are formed on both sides of the vanes 22 to 26, which penetrate through the rotor portion 21 in the radial directions, and which are connected, respectively, to the retard angle hydraulic chambers 9 in the radial directions. Furthermore, as shown in FIG. 1, the rotor portion 21 includes a mounting groove 21*a* which is formed at a center portion of an end surface of the rotor portion 21 on the side of the cam shaft 2, and in which the tip end of the one end portion 2*a* of the cam shaft 2 is mounted.

As shown in FIG. 3, the vanes 22 to 26 are disposed between the shoes 8*a* to 8*e*. Each of the vanes 22 to 26 includes the seal groove which is formed on the tip end surface of the each of the vanes 22 to 26 along the axial direction, and in which a substantially U-shaped seal member 20 is mounted and fixed. The seal members 20 are slidably abutted on the inner circumference surface 11*a* of the housing main body 11.

Moreover, in the vanes 22 to 26, the first vane 22 is a specific vane having a largest width. The other four vanes of the second to fifth vanes 23 to 26 have a substantially identical width which is sufficiently smaller than the width of the first vane 22. In this way, the other four vanes 23 to 26 have the width smaller than the largest width of the first vane 22. With this, it is possible to uniformize an overall weight balance of the vane rotor 7.

When the vane rotor 7 is maximally rotated in a counterclockwise direction as shown in FIG. 3, the one side surface 22*a* of the first vane 22 is abutted on a confronting side surface 8*f* of the first shoe 8*a* to restrict the relative rotational position of the first vane 22 on the maximum retard angle side with respect to the housing 5. Furthermore, when the vane rotor 7 is maximally rotated in a clockwise direction as shown in FIG. 4, the other side surface 22*b* of the first vane 22 is abutted on a confronting side surface 8*g* of the second shoe 8*b* to restrict the relative rotational position of the first vane 22 on the maximum advance angle side with respect to the housing 5.

Figure 4:
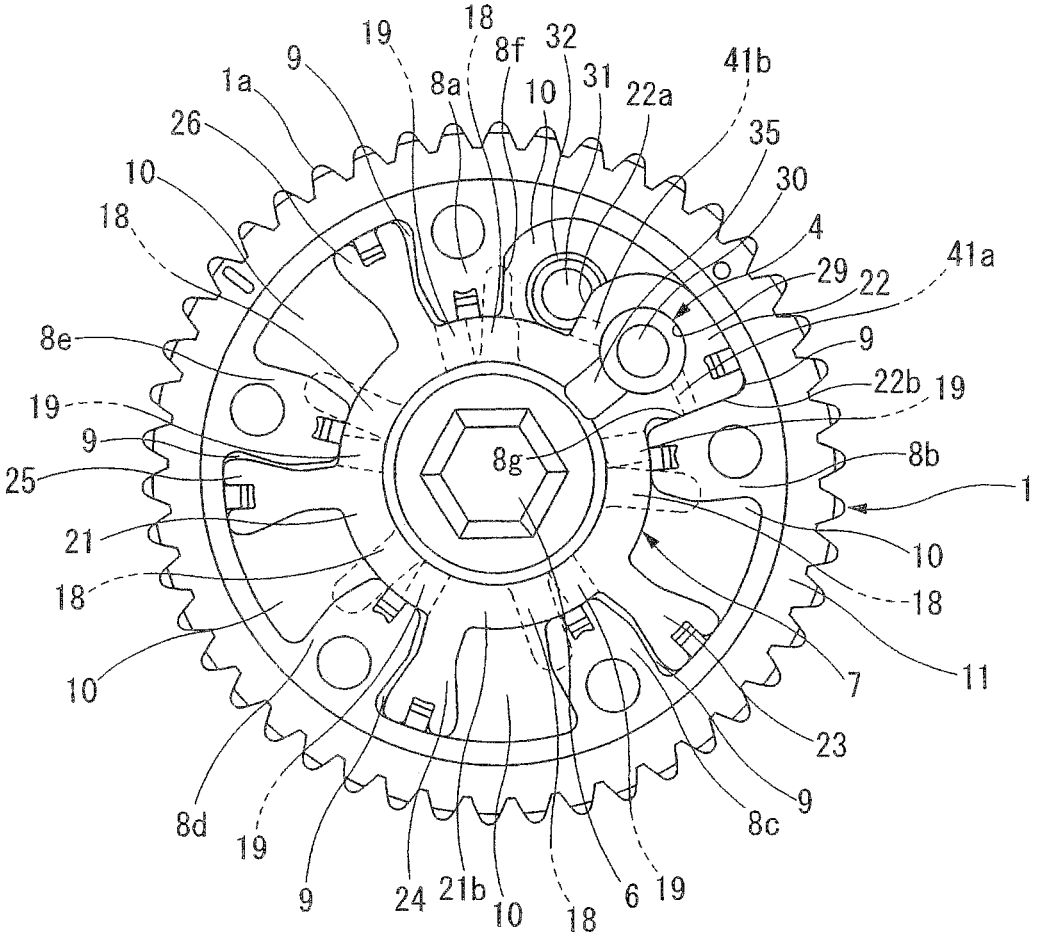
FIG. 4 is a front view showing a state where the front plate is detached, and where the vane rotor is relatively rotated to a maximum advance angle side.

Besides, when each of the both side surfaces 22*a* and 22*b* of the first vane 22 is abutted on the corresponding one of the confronting side surfaces 8*f* and 8*g* of the first and second shoes 8*a* and 8*b*, the other vanes 23 to 25 are not abutted on shoes 8*a* to 8*e* which confront the other vanes 23 to 25 in the circumferential direction, as shown in FIG. 3 and FIG. 4.

As shown in FIG. 1 and FIG. 2, the lock mechanism 4 includes a sliding hole 29 which is formed within the first vane 22 to penetrate through the first vane 22 in the axial direction; a lock pin 30 which is a lock member, which is slidably received within the sliding hole 29, and which is arranged to be moved in forward and rearward directions (to be projectable and retractable) with respect to the rear plate 13 side; a lock hole 31 which is a lock recessed portion, which is formed at a substantially predetermined central position of the rear plate 13 in the radial direction, and with which the tip end portion 30*c* of the lock pin 30 is engaged to lock the vane rotor 7; and an engagement and disengagement mechanism arranged to engage or disengage the tip end portion 30*c* of the lock pin 30 with or from the lock hole 31 in accordance with a start condition of the engine.

Figure 5:
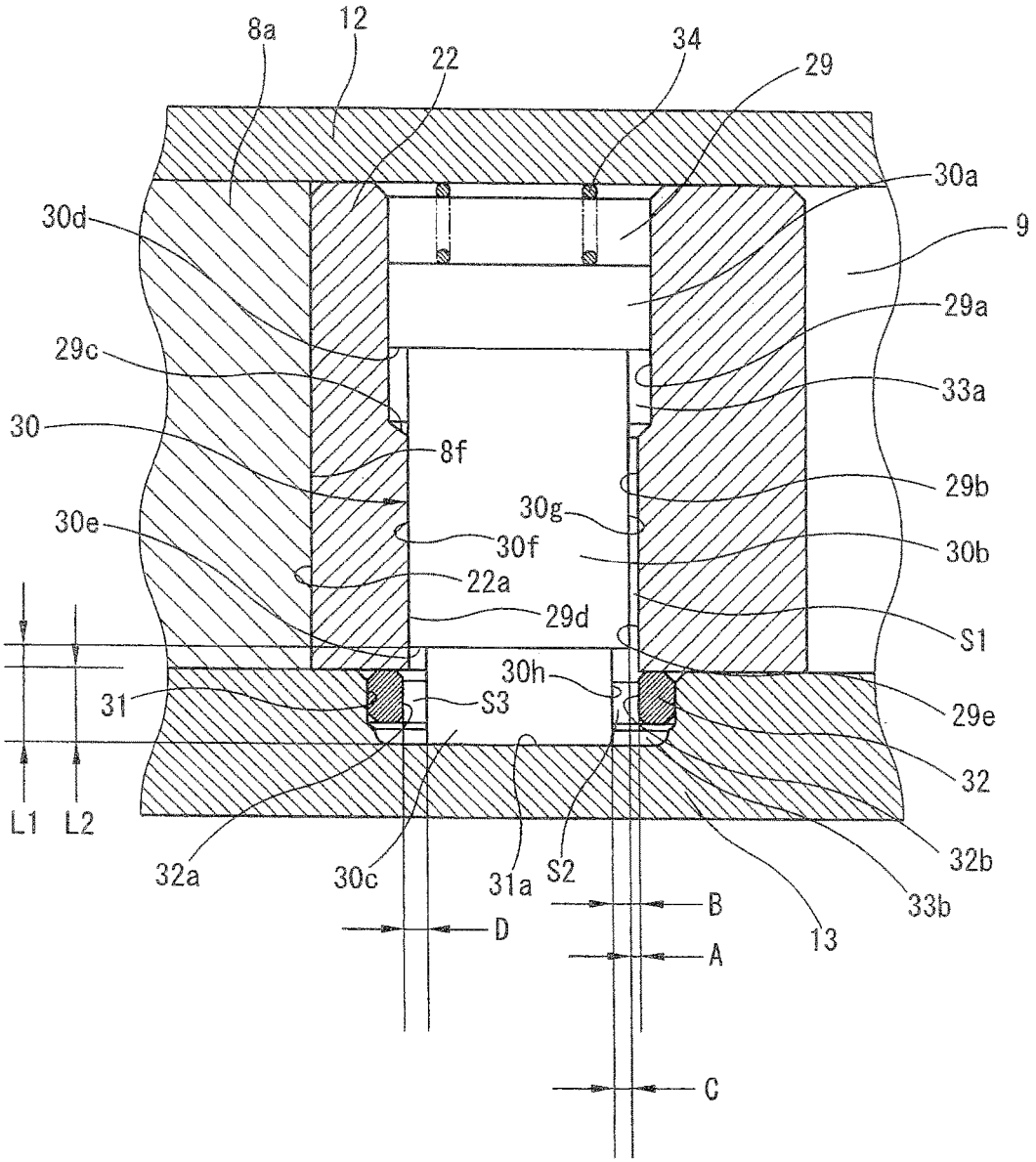
FIG. 5 is an enlarged sectional view showing a main part of the valve timing control device shown in FIG. 1.

As shown in FIG. 1 and FIG. 5, the sliding hole 29 has a stepped inner circumference surface having different diameters. The sliding hole 29 includes a large diameter hole portion 29*a* which is located on the front end side that is the front plate 12 side; and a small diameter hole portion 29*b* which is located on the rear end side. Moreover, the sliding hole 29 includes an annular stepped portion 29*c* formed between the large diameter hole portion 29*a* and the small diameter hole portion 29*b*.

As shown in FIG. 1, FIG. 2, and FIG. 5, the lock pin 30 includes an outer circumference surface having different diameters to correspond to the sliding hole 29 and the lock hole 31. The lock pin 30 includes a flange portion 30*a* having an outer circumference surface arranged to be slidably abutted on the inner circumference surface of the large diameter hole 29*a*; a large diameter portion 30*b* is which is a first shaft portion, which has an outside diameter smaller than that of the flange portion 30*a*, and which is arranged to be slidably abutted on the inner circumference surface of the small diameter hole portion 29*b*; and a tip end portion 30*c* which is a second shaft portion, which is integrally provided on a tip end side of the large diameter portion 30*b*, and which is arranged to be engaged or disengaged with or from the lock hole 31.

The flange portion 30*a* includes a pressure receiving stepped surface 30*d* which is formed at a connection portion between the flange portion 30*a* and the large diameter portion 30*b*, by a difference of outside diameters of the flange portion 30*a* and the large diameter portion 30*b*, and which has an annular shape. A clearance between the outer circumference surface of the flange portion 30*a* and the inner circumference surface of the large diameter hole portion 29*a* is a small size of about 30 μm to suppress the inclination of the lock pin 30.

The large diameter portion 30*b* is formed into a hollow cylindrical shape which is continuous with the flange portion 30*a*. The large diameter portion 30*b* has a uniform overall outside diameter which is slightly smaller than the outside diameter of the small diameter hole portion 29*b* to ensure the sliding movement within the small diameter hole portion 29*b*.

The tip end portion 30*c* has a solid cylindrical shape. The tip end portion 30*c* is formed into a straight shaft having a uniform overall outside diameter. This outside diameter of the tip end portion 30*c* is smaller than that of the large diameter portion 30*b*. Furthermore, a stepped surface 30*e* is formed at a connection portion between the large diameter portion 30*b* and the tip end portion 30*c* by a difference of the outside diameters of the large diameter portion 30*b* and the tip end portion 30*c*, This stepped surface 30*e* is set to have a predetermined radial width C for a relationship with the clearances as described later.

Besides, the tip end portion 30*c* may be formed into a conical shape so that the tip end portion 30*c* is easy to be inserted into a sleeve 32 (described later) of the lock hole 31.

The lock hole 31 is formed at a predetermined position of the rear plate 13. The lock hole 31 has a bottomed groove shape having a substantially perfect circular shape. The annular sleeve 32 made from abrasion resistance material is inserted in the inner circumference surface of the lock hole 31 by the press-fit. That is, this lock hole 31 is formed on the inner side surface of the rear plate 13 at a position at which the tip end portion 30*c* of the lock pin 30 confronts the lock hole 31 in the axial direction when the vane rotor 7 is relatively rotated on the maximum retard angle side as shown in FIG. 3.

As shown in FIG. 5, this lock hole 31 has a depth L2 from an opening end edge to an inner bottom surface 31*a*. This depth L2 of the lock hole 31 is smaller than an axial length L1 of the tip end portion 30*c* of the lock pin 30. Accordingly, when the lock pin 30 is inserted and engaged in the lock hole 31 and the tip end surface of the tip end portion 30*c* is abutted on the inner bottom surface 31*a* of the lock hole 31, the entire of the tip end portion 30*c* is not inserted and engaged in the lock hole 31, and the stepped surface 30*e* is positioned within the small diameter hole portion 29*b*.

The sleeve 32 constitutes a part of the lock hole 31. The sleeve 32 includes an inner circumference surface 32*a* having a substantially perfect circular shape. The inner circumference surface 32*a* has an inside diameter which is substantially identical to the outside diameter of the large diameter portion 30*b* of the lock pin 30, and which is larger than the outside diameter of the outer circumference surface of the tip end portion 30*c*. Accordingly, when the tip end portion 30*c* is inserted and engaged in the sleeve 32, an annular clearance is formed between the inner circumference surface 32*a* and the outer circumference surface of the tip end portion 30*c*, as shown in FIG. 5.

Furthermore, when the one side surface 22*a* of the first vane 22 is abutted on the confronting side surface 8*f* of the first shoe 8*a* and the tip end portion 30*c* of the lock pin 30 is inserted and engaged in the lock hole 31 (the sleeve 32) as shown in FIG. 5, the relative rotation angle of the vane rotor 7 with respect to the housing 5 is set to be the maximum retard conversion angle appropriate for the engine start.

Moreover, when the relative rotation angle of the vane rotor 7 is the maximum retard conversion angle, a first clearance S1 is formed between the small diameter hole portion 29*b* of the sliding hole 29 and the large diameter portion 30*b* of the lock pin 30 on a side opposite to the side of the abutment between the first vane 22 and the first shoe 8*a* in the circumferential direction. Furthermore, a second clearance S2 is formed between the tip end portion 30*c* of the lock pin 30 and a confronting end surface 32*b* of the inner circumference surface 32*a* of the sleeve 32.

Then, a concrete relationship among widths A and B of the clearances S1 and S2, and a width C of the stepped surface 30*e* between the large diameter portion 30*b* and the tip end portion 30*c* is explained with reference to FIG. 5 in the assembling method of constituting components as described later.

A first pressure receiving chamber 33*a* having an annular shape is formed between the stepped portion 29*c* of the sliding hole 29, and a pressure receiving stepped portion 30*d* of the lock pin 30. A second pressure receiving chamber 33*b* is formed between the tip end portion 30*c* of the lock pin 30 and the lock hole 31, that is, on a side of the inner bottom surface 31*a* of the lock hole 31. These first and second pressure receiving chambers 33*a* and 33*b* constitute a part of a disengagement hydraulic pressure circuit described later.

As shown in FIG. 1 and FIG. 2, a connection groove 35 is cut and formed on a rear surface of the vane rotor 7 on the rear end side of the sliding hole 29. This connection groove 35 has an elongated groove shape extending radially from an edge of the lock hole 31 to an edge of the insertion hole 7*a*. The connection groove 35 is connected to the atmosphere through an annular clearance S formed between the inner circumference surface of the insertion hole 12*a* of the front plate 13 and the outer circumference surface of the seat portion 6*d* of the cam bolt 6. In this way, the sliding hole 29 is connected to the atmosphere. With this, it is possible to constantly ensure the good slidability of the lock pin 30 within the sliding hole 29 in a range of the rotation of the vane rotor 7.

The engagement and disengagement mechanism includes a coil spring 34 which is elastically mounted between the inner bottom surface of the large diameter portion 30*b* of the lock pin 30, and the inner end surface of the front plate 12, and which is arranged to urge the lock pin 30 in the forward direction (toward the lock hole 31); and the disengagement hydraulic circuit arranged to supply the hydraulic pressure to the first and second pressure receiving chambers 33*a* and 33*b*, and thereby to move the lock pin 39 in the rearward direction against the spring force of the coil spring 34.

When the vane rotor 7 is relatively rotated to the maximum retard angle phase position, the coil spring 34 is arranged to move the lock pin 30 in the forward direction by the spring force to insert and engage the tip end portion 30*c* in the lock hole 31 (the sleeve 32), and thereby to lock the vane rotor 7 with respect to the housing 5.

As shown in FIG. 3 and FIG. 4, this disengagement hydraulic circuit is arranged to supply the hydraulic pressure supplied to the retard angle hydraulic chambers 9 and the advance angle hydraulic chambers 10, to the first pressure receiving chamber 33*a* and the second pressure receiving chamber 33*b* through a first oil hole 41*a* and a second oil hole 41*b* which are formed from the other side surface 22*b* of the first vane 22 in the circumferential direction, and on the axial one end surface.

The lock pin 30 is arranged to be moved by the hydraulic pressure supplied to these first and second pressure receiving chambers 33*a* and 33*b*, against the spring force of the coil spring 34 in the disengagement direction, that is, in the rearward direction. The engagement between the tip end portion 30*c* and the lock hole 31 is released so as to allow the free relative rotation of the vane rotor 7 with respect to the housing 5.

The first oil hole 41*a* is formed within the first vane 22 in a widthwise direction of the vane 22 from one end opening formed on the other side surface 22*b* (the retard angle hydraulic chamber 9 side) of the first vane 22, to the other end opening connected to the first pressure receiving chamber 33*a*. On the other hand, the second oil hole 41*b* is formed on the axial one end surface of the first vane 22 into a groove shape along the radial direction. The second oil hole 41*b* includes one end connected to one of the advance angle side oil grooves 18, and the other end connected to the second pressure receiving chamber 33*b*.

The hydraulic circuit is arranged to selectively supply the hydraulic pressure to the retard angle and advance angle hydraulic chambers 9 and 10, or to selectively discharge the hydraulic pressure from the retard angle and advance angle hydraulic chambers 9 and 10. As shown in FIG. 1, the hydraulic circuit includes the retard angle side passage 36 connected to the retard angle side oil holes 19; the advance angle side passage 37 connected to the advance angle side oil grooves 18; an electromagnetic switching valve 38 provided between the is passages 36 and 37; an oil pump 39 arranged to supply the hydraulic pressure through the electromagnetic switching valve 38 to the passages 36 and 37; and a drain passage 40 arranged to be selectively connected through the electromagnetic switching valve 38 to the retard angle side and advance angle side passages 36 and 37. Besides, a suction passage 39*b* of the oil pump 39 and a drain passage 40 are connected to an oil pan 42.

The retard angle side and advance angle side passages 36 and 37 include one ends which are connected, respectively, to the oil grooves 18 and the oil holes 19 through oil passage holes 36*a* and 37*a* formed in the radial direction of the cam shaft one end portion 2*a*, and within the cam shaft one end portion 2*a* in the axial direction, and grooves 36*b* and 37*b* located on the outer circumference side.

The electromagnetic switching valve 38 is a three-port two-position valve. The electromagnetic switching valve 38 is arranged to selectively control and switch the passages 36 and 37, and the discharge passage 39*a* of the oil pump 39 and the drain passage 40, in accordance with an output signal from a controller (not shown).

The controller includes a computer configured to receive information signals from various sensors such as a crank angle sensor, an air flow meter, a water temperature sensor, and a throttle valve opening degree sensor (not shown), and to sense a current driving state of the engine. Moreover, the controller is configured to output a control current to a coil of the electromagnetic switching valve 38 in accordance with the driving state of the engine.

[Assembling Method]

Hereinafter, an assembling method of the vane rotor 7 and so on with respect to the housing 5 is explained with reference to FIG. 6.

Firstly, the rear plate 13 is mounted on an upper surface of a base 50, as shown in FIG. 6A. At this time, the rear plate 13 is not fixed so that the rear plate 13 is rotatable about a cylindrical protruding portion (not shown) inserted into the insertion hole 12*a*. Besides, this rear plate 13 includes the lock hole 31 which is formed at the predetermined position on the inner side surface of the rear plate 13, and in which the sleeve 32 is previously press-fit in the inner circumference surface.

Next, the entire vane rotor 7 is received and assembled within the housing main body 11 from the axial direction while the vanes 18*a* to 18*e* are positioned in the corresponding spaces between the shoes 8*a* to 8*e* of the housing main body 11. Thus-assembled entire unit is mounted on an upper surface of the rear plate 13 while the mounting groove 21*a* of the rotor 21 is mounted on the protruding portion from the above (first process).

Then, a clamping mechanism (not shown) supports the outer circumference surface of the housing main body 11 at three points at about 120 degree interval so as to restrict the free rotation and the upward and downward movements of the housing main body 11 (second process).

Next, as shown in FIG. 6A, a rod-shaped pin corresponding jig 51 corresponding to the lock pin 30 is inserted from the above into the sliding hole 29 of the first vane 22, so that a tip end portion 51*a* of the pin corresponding jig 51 is inserted from the large diameter hole portion 29*a* and the small diameter hole portion 29*b* into the sleeve 32. With this, the inner circumference surface of the sliding hole 29 and the inner circumference surface 32*a* of the sleeve 32 are positioned relative to each other (third process).

The pin corresponding jig 51 has a straight shaft having a uniform entire outside diameter which is substantially identical to the outside diameter of the large diameter portion 30*b* of the lock pin 30.

Next, as shown in FIG. 6B, the rear plate 13 is rotated in a leftward direction (clockwise direction) shown by an arrow. With this, the vane rotor 7 is pressed and rotated by the pin corresponding jig 51 whose the tip end portion 51*a* is inserted and engaged in the sleeve 32. Consequently, the one side surface 22*a* of the first vane 22 is abutted on the confronting side surface 8*f* of the first shoe 8*a*, so that the clearance between the both side surfaces 8*f* and 22*a* is disappeared (fourth process). By this pressing force, the flatness (flattering) of the just touch (zero touch) between the both side surfaces 8*f* and 22*a* is obtained so as to correct the processing error, the inclination and so on of the both side surfaces 8*f* and 22*a*. Moreover, at this time, a radial one side of the outer circumference surface of the pin corresponding jig 51 which is positioned on a side of the abutted both side surfaces 8*f* and 22*a*, and the confronting end surface 29*d* of the small diameter portion 29*b* on the radial one side are abutted on each other in the radial direction of the lock pin. Furthermore, a radial one side of the outer circumference surface of the pin corresponding jig 51 which is positioned on a side opposite to the abutted both side surfaces 8*f* and 22*a*, and the confronting end surface 32*b* of the inner circumference surface 32*a* of the sleeve 32 confronting that radial one end side in the radial direction are abutted on each other in the radial direction. By this fourth process, it is possible to disappear the clearance of the pin corresponding jig 51 on the side of the one side surface 22*a*, and to decrease the clearance between the pin corresponding pin 51 and the inner circumference surface of the sleeve 32 on the side opposite to the one side surface 22*a* of the first vane 22 in the radial direction.

Then, the pressing force of the one side surface 22*a* of the first vane 22 with respect to the confronting side surface 8*f* of the first shoe 8*a* is released. Subsequently, as shown in FIG. 6C, the pin corresponding jig 51 is pulled out from the sleeve 31 and the sliding hole 29. Then, the normally-used lock pin 30 is inserted into the sliding hole 29 and the lock hole 31 (the sleeve 32) (fifth process).

After this insertion of the lock pin 30, the coil spring 24 is elastically disposed between the rear end portion of the lock pin 30 and the front plate 12, as shown in FIG. 5 and FIG. 6D, so that the tip end surface of the tip end portion 30*c* of the lock pin 30 is elastically abutted on the inner bottom surface 31*a* of the lock hole 31 by this spring force of the coil spring 34. Moreover, the front plate 12, the housing main body 11, and the rear plate 13 are fixed and tightened together in this state by the bolts 14. With this, the assembling operation is finished.

The tip end portion 30*c* of the lock pin 30 has the outside diameter smaller than the outside diameter of the pin corresponding jig 51, as shown in FIG. 6D. Accordingly, in a state where the lock pin 30 is inserted and engaged in the lock hole 31, the clearance between the outer circumference surface of the tip end portion 30*c* and the inner circumference surface 32*a* of the sleeve 32 is greater than that in case of the pin corresponding jig 51.

Moreover, as shown in FIG. 5 and FIG. 6D, the end edge 30*f* on the one side of the outer circumference surface of the large diameter portion 30*b* which is positioned on the side of the abutted side surfaces 8*f* and 22*a*, and the confronting end surface 29*d* on the one side of the small diameter hole portion 29*b* which confronts the end edge 30*f* in the radial direction are abutted on each other in the radial direction. With this, the clearance is not formed between the end edge 30*f* and the confronting end surface 29*d*.

However, the first clearance S1 is formed between the end edge 30*g* on the other side of the large diameter portion 30*b*, and the confronting end surface 29*e* on the other side of the small diameter hole portion 29*b*. The end edge 30*g* of the large diameter portion 30*b* and the confronting end surface 29*e* of the small diameter hole portion 29*b* are positioned on the side opposite to the end edge 30*f* and the confronting end surface 29*d* that are abutted on each other on the one side, in the circumferential direction of the vane rotor 7 (in the radial direction of the lock pin 30). Moreover, the second clearance S2 is formed between the end edge 30*h* on the is other side of the tip end portion 30*c* of the lock pin 30, and the confronting end surface 32*b* on the other side of the inner circumference surface 32*a* of the sleeve 32 which confronts the end edge 30*h*, on the side identical to the forming position of the first clearance S1. Furthermore, the annular stepped surface 30*e* is formed at the connection portion between the large diameter portion 29*b* and the tip end portion 29*c* of the lock pin 30 by the difference of the outside diameters of the large diameter portion 29*b* and the tip end portion 29*c*, as described above.

The first clearance S1 has a maximum radial width A. The second clearance S2 has a maximum radial width B. Moreover, the stepped surface 30*e* has a radial width C.

A relationship among the width A of the first clearance S1, the width B of the second clearance S2, and the width C which is the radial length of the stepped surface 30*e* is B≈C>A.

That is, in this mounting direction, the width B of the second clearance S2 is substantially identical to the width C of the stepped surface 30*e*. Only by the setting of the width C of the stepped surface 30*e*, it is possible to set the width B of the second clearance S2. That is, the second clearance S2 is a range in which the tip end 30*c* of the lock pin 30 can be moved within the sleeve 32. It is possible to set, with the high accuracy, the movable range in the state where the tip end 30*c* of the lock pin 30 is inserted into the sleeve 32, by the setting of the width C of the stepped surface 30*e*, irrespective of the accumulation of the error due to the combination of the components.

In this case, B≈C (B is substantially identical to C) supposes that a size difference is within about ±50 μm in consideration of the manufacturing error and so on. That is, it is possible to set by the tolerance of about ±50 μm with respect to the target clearance (backlash amount). That is, the backlash amount by which the tip end 30*c* of the lock pin 30 can be moved about the rotation axis of the vane rotor 7 in the circumferential direction can be set by the width C of the stepped surface 30*e*.

Besides, the width D of the third clearance S3 formed on a side opposite to the second clearance B in the radial direction in this state is greater than the width B of the second clearance S2, the width A of the first clearance S1, and the width C of the stepped surface 30*e*. That is, D>B≈C>A is satisfied.

The above-described width A of the first clearance S1, the width B of the second clearance S2, and the width C of the stepped surface 30*e* are previously mechanically set before the assembly of the constituting components. That is, the width A of the first clearance S1, the width B of the second clearance S2, and the width C of the stepped surface 30*e* are previously set to satisfy the above-described relationship of B≈C>A.

In this case, the edge 30*f* on the one side is a portion at which the large diameter portion 30*b* of the lock pin 30 and the small diameter hole portion 29*b* are abutted on each other in a state where the one end surface 22*a* of the first vane 22 is pressed on the confronting side surface 8*f* of the first shoe 8*a*, and the large diameter portion 30*b* of the lock pin 30 is pressed on the small diameter hole portion 29*b* on the side of the confronting side surface 8*f*. The edge 30*f* on the one side is one side of the large diameter portion 30*b* of the lock pin 30 in the radial direction.

The end edge 30*g* on the other side is positioned at a position opposite to the end edge 30*f* and the confronting end surface 29*d* which are abutted on each other on the one side, in the circumferential direction of the vane rotor 7 (in the radial direction of the lock pin 30). The end edge 30*g* on the other side is an end edge on a side opposite to the one side end edge 30*f* in a section defined by connecting the one side end edge 30*f* and the axis of the lock pin 30. The other side end edge 30*g* is on the other side of the large diameter portion 30*b* in the radial direction.

The confronting end surface 32*b* is the inner circumference surface 32*a* of the sleeve 32 which confronts the other side end edge 30*h* of the tip end portion 30*c* of the lock pin 30 in the above-described section. The confronting end surface 32*b* is the other side of the inner circumference surface of the lock recessed portion in the radial direction.

Operations of this Embodiment

Hereinafter, operations of this embodiment are explained. Firstly, at the stop of the engine, the pump operation of the oil pump 39 is stopped, so that the supply of the hydraulic fluid to the hydraulic chambers 9 and 10 is stopped. With this, as shown in FIG. 3, the vane rotor 7 is rotated in the leftward direction shown in the drawing, by is the alternating torque acted to the cam shaft 2, and relatively rotated to the maximum retard angle position. At this position, the tip end portion 30*c* of the lock pin 30 is inserted and engaged in the lock hole 31 (the sleeve 32) by the spring force of the coil spring 34 so as to lock the vane rotor 7 at a position appropriate for the start of the engine.

Next, when the ignition switch is operated to the ON state to start the engine, that is, in an initial stage of the cranking, the controller maintains the deenergization state of the electromagnetic coil of the electromagnetic switching valve 38. With this, the discharge passage 39*a* of the oil pump 39 and the retard angle side passage 36 are connected. At the same time, the advance angle side passage 37 and the drain passage 40 are connected.

Accordingly, the hydraulic fluid discharged from the oil pump 39 flows through the electromagnetic switching valve 38 and the retard angle side passage 36 into the retard angle hydraulic chambers 9, so that the retard angle hydraulic chambers 9 become high pressure. On the other hand, the hydraulic fluid within the advance angle hydraulic chambers 10 is discharged through the advance angle side passage 37 and the drain passage 40 into the oil pan 42, so that the advance angle hydraulic chambers 10 become low pressure.

In this case, the hydraulic pressure supplied to the retard angle hydraulic chambers 9 flows through the first oil hole 41*a* into the annular first pressure receiving chamber 33*a*. However, the hydraulic pressure is low at this initial timing. Accordingly, the lock pin 30 is not moved in the rearward direction, so that the tip end portion 30*c* is engaged in the lock hole 31 (the sleeve 32) by the spring force of the coil spring 34.

Accordingly, the vane rotor 7 is maintained in the lock state at this initial timing of the cranking for the start of the engine. The vane rotor 7 is positioned at the relative rotation position of the maximum retard angle. Consequently, it is possible to obtain the good startability by the smooth cranking, and to suppress the flapping (fluttering). Moreover, it is possible to suppress the interference between the vanes 22 to 26 and the shoes 8*a* to 8*e*. Therefore, in particular, it is possible to suppress the generation of the hammering noise (hitting noise) of the interference between the first vane 22 and the shoes 8*a* and 8*b*.

Then, the pump discharge pressure becomes high, so that the hydraulic pressure supplied to the retard angle hydraulic chambers 9 become high. This high pressure flows into the first pressure receiving chamber 33*a* so that the first pressure receiving chamber 33*a* become the high pressure. With this, the lock pin 30 is moved in the rearward direction, so that the tip end portion 30*c* is pulled out from the lock hole 31 so as to ensure the free relative rotation of the vane rotor 7 with respect to the housing 5.

Accordingly, as shown in FIG. 3, the vane rotor 7 is rotated in the counterclockwise direction in accordance with the preservation of the enlargement state of the volumes of the retard angle hydraulic chambers 9. With this, the one side surface 22*a* of the first vane 22 is abutted on the confronting side surface 8*f* of the first shoe 8*a* to restrict the further rotation of the vane rotor 7 in the counterclockwise direction. With this, the relative rotation angle of the vane rotor 7, that is, the cam shaft 2 with respect to the housing main body 11 (the sprocket 1) is maintained to the maximum retard angle side.

Next, when the engine is shifted to a predetermined engine driving state such as an idling state, the controller outputs control current to the electromagnetic switching valve 38 to start the operation. The discharge passage 39*a* and the advance angle side passage 37 are connected. At the same time, the retard angle side passage 36 and the drain passage 40 are connected. With these, the hydraulic pressure within the retard angle hydraulic chambers 9 is discharged, so that the retard angle hydraulic chambers 9 become the low pressure. Moreover, the hydraulic fluid is supplied to the advance angle hydraulic chambers 10, so that the advance angle hydraulic chambers 10 become the high pressure. At this time, the hydraulic pressure is supplied from one of the advance angle hydraulic chambers 10 through the second connection hole 41*b* to the second pressure receiving chamber 33*b*. By this hydraulic pressure, the lock pin 30 is maintained to be pulled out from the lock hole 31 (the sleeve 32).

Accordingly, as shown in FIG. 4, the vane rotor 7 is rotated in the clockwise direction with respect to the housing main body 11. The other side surface of the first vane 22 is abutted on the confronting side surface of the second shoe 8*b* so as restrict the further rotation of the vane rotor 7 in the clockwise direction. With this, the relative pivot phase of the cam shaft 2 with respect to the is sprocket 1 is converted to the maximum advance angle side. Consequently, the opening and closing timing of the intake valve is controlled to the maximum advance angle side. Therefore, it is possible to improve the performance of the engine in this driving region.

Moreover, in this embodiment, as described above, the size relationship among the width A of the first clearance S1, the width B of the second clearance S2, and the width C of the stepped surface 30*e* is previously set to satisfy the relationship of B≈C>A. The constituting components are assembled based on this specific configuration. Accordingly, it is possible to adjust the circumferential clearance between the tip end portion 30*c* of the lock pin 30 and the lock hole 31 (the sleeve 32) with the high accuracy.

That is, as described above, the high accuracy of the clearance between the outer circumference surface of the lock pin 30 and the lock hole 32 in the circumferential direction of the vane rotor 7 is required for ensuring the smooth engagement and disengagement characteristics of the tip end portion 30*c* of the lock pin 30 with the lock hole 32, and for suppressing the hammering noise (the hitting noise) between the one side end surface 22*a* of the first vane 22 and the confronting side surface 8*f* of the first shoe 8 due to the positive and negative alternating torque generated in the cam shaft 2 in the initial stage of the engine start and so on.

Accordingly, in this embodiment, the axial length L1 of the tip end portion 30*c* of the lock pin 30 is set to be greater than the groove width L2 of the lock hole 31. Moreover, the outside diameter of the tip end portion 30*c* of the lock pin 30 is set to be smaller than that of the large diameter portion 30*b*.

Furthermore, in a state where the one side surface 22*a* of the first vane 22 is abutted on the confronting side surface 8*f* of the first shoe 8*a* in the circumferential direction, the relationship among the width A of the first clearance S1, the width B of the second clearance S2, and the width C of the stepped surface 30*e* by the difference of the outside diameters of the large diameter portion 30*b* and the small diameter portion 30*c*, on the side opposite to the abutment side in the circumferential direction is set to B≈C>A as described above.

The widths A to C are the values obtained from many experimental results by inventors of the present invention. With this, it is possible to ensure the good engagement and disengagement characteristics of the lock pin 30 with respect to the lock hole 31 (the sleeve 32), and to suppress the noise of the impact (the hammering noise) between the both side surfaces 22*a* and 8*f* of the first vane 22 and the first shoe 8*a* which confront each other at the start of the engine, as described above.

In particular, in this embodiment, the clearance is not adjusted by the visual inspection like the conventional art. In this embodiment, the assembly operation is performed based on the clearance widths A and B and the step width C which are previously set. With this, it is possible to automatically adjust the circumferential clearance. Accordingly, it is possible to remarkably decrease the number of the components. Moreover, it is possible to readily adjust the clearance, and to improve the working efficiency of the adjustment.

That is, the radial clearance can be managed only by the difference of the outside diameters of the large diameter portion 30*b* and the tip end portion 30*c* of the lock pin 30, and the inside diameter of the sliding hole 29. Accordingly, it is possible to remarkably decrease the number of the components, and to improve the working efficiency of the adjustment of the clearance, as described above.

Moreover, the tip end portion 30*c* of the lock pin 30 is formed into the straight shaft having the uniform outside diameter. Accordingly, it is possible to accurately set the width B and the width C of the second clearance S2 and the stepped surface 30*e* which are based on the tip end portion 30*c* of the lock pin 30.

Furthermore, the inner circumference surface 32*a* of the sleeve 32 in which the tip end portion 30*c* is inserted and engaged is formed into a substantially perfect circle shape. Accordingly, it is also possible to accurately set the first clearance S1.

In this way, it is possible to accurately set the widths A and B of the clearances S1 and S2, and the width C of the stepped surface 30*e*. Accordingly, it is possible to further accurately adjust the circumferential clearance between the tip end portion 30*c* and the lock hole 31 (the sleeve 32).

Furthermore, the width D of the third clearance S3 is set to be greater than the width B of the second clearance S2, the width A of the first clearance S1, and the width C of the stepped surface 30*e*. Accordingly, the tip end portion 30*c* of the lock pin 30 can be constantly smoothly engaged with and disengaged from the lock hole 31 (the sleeve 32).

Second Embodiment

FIGS. 7A to 7D show an assembly process in a second embodiment. In this embodiment, a structure of the pin corresponding jig 52 is varied. That is, basically, the pin corresponding jig 52 has the outside diameter identical to that of the large diameter portion 30*b* of the lock pin 30. However, the pin corresponding jig 52 includes a tip end portion corresponding portion 52*a* which is located at a tip end portion of the pin corresponding jig 52, and which corresponds to the tip end portion 30*c* of the lock pin 30.

This tip end portion corresponding portion 52*a* has an outside diameter greater than that of the tip end portion 30*c*.

Besides, the outside diameters of the large diameter portion 30*b* and the tip end portion 30*c* of the lock pin 30, and the inside diameter of the sleeve 32 are set to be identical to those in the first embodiment.

Figure 6:
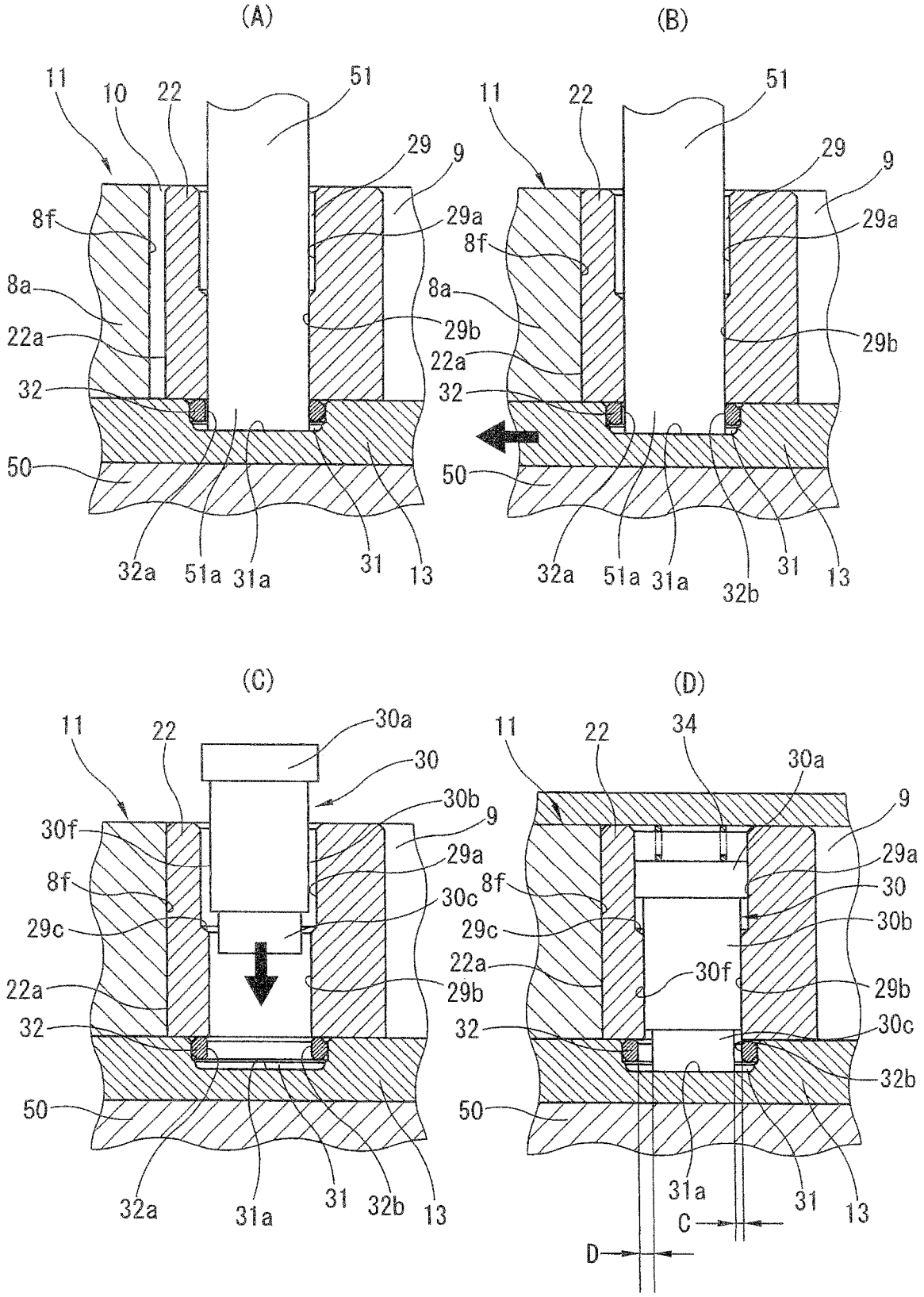
FIG. 6 show a process of assembling the vane rotor to the housing in this embodiment.

The assembly process of the constituting components is identical to that of the first embodiment shown in FIG. 6. Accordingly, this is briefly explained below.

Figure 7:
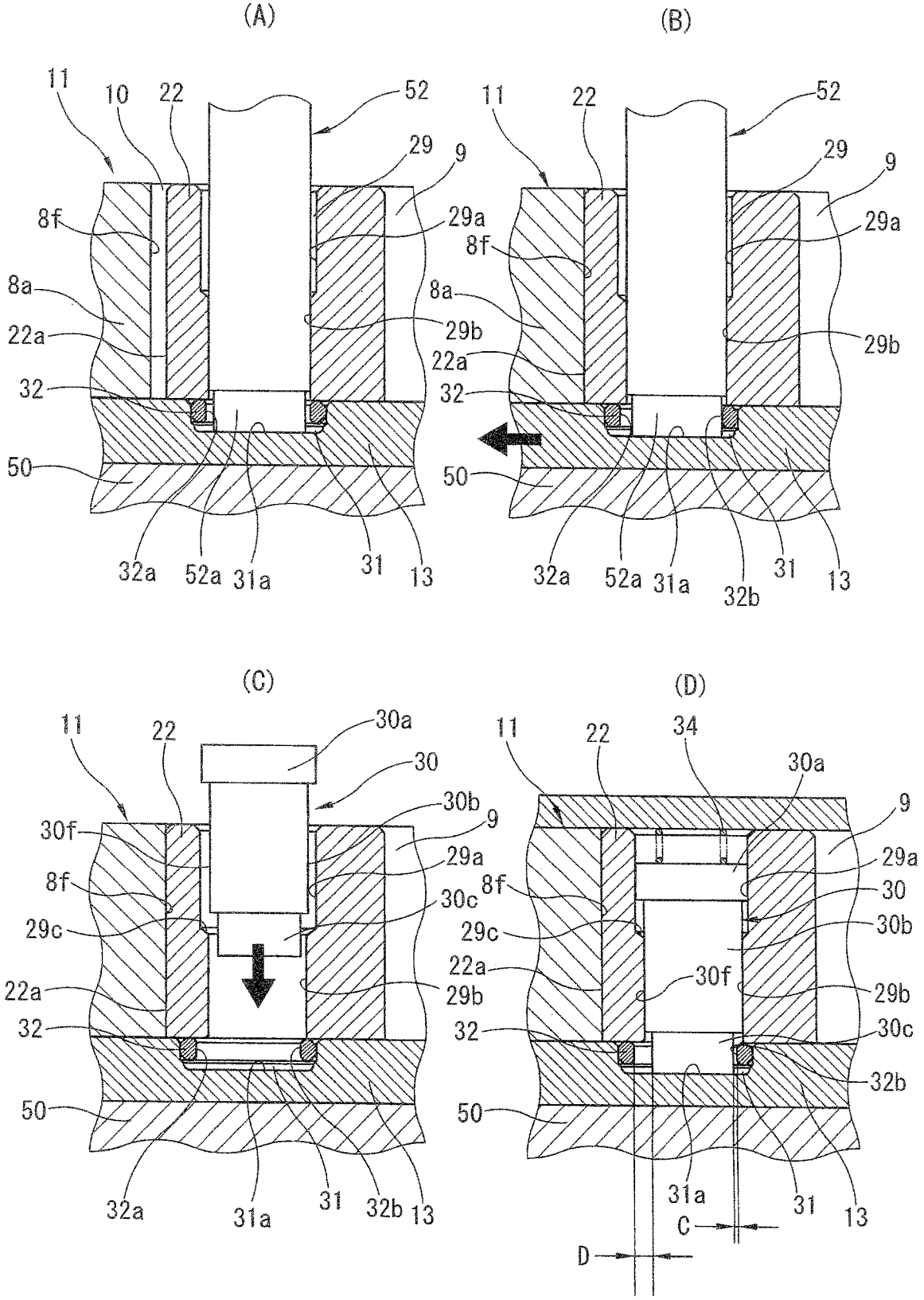
FIG. 7 show a process of assembling the vane rotor to the housing in a second embodiment.

First and second processes are identical to the above-described first and second processes. Accordingly, the explanations are omitted. At a third process, as shown in FIG. 7A, the pin corresponding jig 52 which has a rod shape, and which corresponds to the lock pin 30 is inserted from the above into the sliding hole 29 of the first vane 22. Then, the tip end portion 52*a* of the pin corresponding jig 52 is inserted from the large diameter portion 29*a* into the sleeve hole 31*a* of the sleeve 32. With this, the sliding hole 29 and the sleeve hole 31*a* are relatively positioned.

Next, at a fourth process, as shown in FIG. 7B, when the rear plate 13 is rotated in the leftward direction (the clockwise direction) as shown by an arrow, the pin corresponding jig 51 in a state where the tip end portion corresponding portion 52*a* is inserted and engaged in the inner circumference surface 32*a* of the sleeve 32 pushes and rotates the vane rotor 7 in the same direction. With this, the one side surface 22*a* of the first vane 22 is abutted on the confronting side surface 8*f* of the first shoe 8*a*, so that the clearance between the both side surfaces 8*f* and 22*a* is disappeared. At this time, a portion of the inner circumference surface 32*a* of the sleeve 32 which is located on a right side of the drawing (the confronting end surface 32*b* on the other side) is abutted on the outer circumference surface of the tip end portion corresponding portion 52*a* of the pin corresponding jig 52.

Then, the pressing force of the one side surface 22*a* of the first vane 22 with respect to the one side surface 8*f* of the first shoe 8*a* is released. Then, as shown in FIG. 7C, the pin corresponding jig 52 is pulled out from the lock hole 31 (the sleeve 32) and the sliding hole 29. Subsequently, the normally-used lock pin 30 is inserted into the sliding hole 29 and the lock hole 31 (the sleeve 32).

After this insertion of the lock pin 30, as shown in FIG. 7D, the coil spring 34 is elastically mounted between the rear end portion of the lock pin 30 and the front plate 12. By the spring force of this coil spring 34, the tip end surface of the tip end portion 30*c* of the lock pin 30 is elastically abutted on the inner bottom surface 31*a* of the lock hole 31. Moreover, in this state, the front plate 12, the housing main body 11, and the rear plate 13 are tightened and fixed together by the bolts 14. With these, the assembly operation is finished.

In this embodiment, the outside diameter of the tip end portion 52*a* of the pin corresponding jig 52 is set to be smaller than that in the first embodiment. Accordingly, a width E of the second clearance S2 at the assembly operation is different from that in the first embodiment. That is, at the assembly operation of the constituting components, when the lock pin 30 is finally inserted into the sliding hole 29 so that the tip end portion 30*c* is inserted and engaged in the lock hole 31, the widths A and C of the first clearance S1 and the stepped surface 30*e* between the large diameter portion 30*b* and the tip end portion 30*c* are identical to those in the first embodiment. However, the width E of the second clearance S2 is set to be smaller than the width B in the first embodiment.

Accordingly, the relationship among the width A of the first clearance S1, the width E of the second clearance S2, and the width of the stepped surface 30*e* is set to satisfy E≈C>A.

The small width E slightly influences on the accuracy of the clearance between the outer circumference surface of the tip end portion 30*c* of the lock pin 30, and the inner circumference surface of the sleeve 32. However, this influence is not a large influence such as the deterioration of the accuracy by which the hammering noise (the hitting noise) is generated between the first vane 22 and the first shoe 8*a*. Accordingly, in this embodiment, it is also possible to obtain the operations and effects which are identical to those in the above-described first embodiment.

The present invention is not limited to the configurations of the embodiments. For example, the sleeve 32 may be omitted. Moreover, it may be constituted only by the lock hole 31 having the small inside diameter.

Moreover, the flange portion 30*a* of the lock pin 30 may be omitted. The large diameter portion 30*b* may be slidably guided by the small diameter hole portion 29*b* of the sliding hole 29. In this case, the first pressure receiving chamber 33*a* may be also omitted, and it may be constituted only by the second pressure receiving chamber 33*b*. In this case, the hydraulic pressure is selectively supplied from both the retard angle hydraulic chambers 9 and the advance angle hydraulic chambers 10 to the second pressure receiving chamber 33*b*, so that the lock pin 30 is moved in the rearward direction against the spring force of the coil spring 34.

Moreover, in the embodiments, the valve timing control device is applied to the intake valve. However, the valve timing control device may be applied to the exhaust side. In this case, the vane rotor 7 is arranged to be is locked at the maximum advance angle position. Accordingly, the lock hole 31 is formed at a predetermined position on the advance angle side, in place of the position shown in FIG. 4.

Furthermore, in the embodiments, the sliding hole 29 of the lock pin 30 is provided in the first vane 22. However, for example, the sliding hole may be formed in the rotor portion 21 by increasing the diameter of the rotor portion 21.

In another preferable aspect of the present invention, a valve timing control device includes: a housing main body which includes a plurality of shoes integrally provided on an inner circumference of the housing main body, and which has a cylindrical shape having at least one end opening located at an one end of the housing main body in an axial direction; a plate member closing the one end opening of the housing main body; a vane rotor which is fixed to the cam shaft, which includes a plurality of vanes separating portions between the plurality of the shoes of the housing main body into retard angle operation chambers and advance angle operation chambers, and which is arranged to be rotated on a retard angle side or an advance angle side relative to the housing by supply and discharge of a hydraulic pressure to and from the advance angle operation chambers and the retard angle operation chambers; a lock recessed portion formed on an inner bottom surface of the housing main body or an inner side surface of the plate member; a lock pin which is slidably disposed within a sliding hole formed within a specific vane of the plurality of the vanes in the axial direction, and which includes a first shaft portion that has a large diameter, and that is arranged to be slidably moved on an inner circumference surface of the sliding hole, and a second shaft portion that is integrally provided on a tip end side of the first shaft portion, that has a diameter smaller than the diameter of the first shaft portion, and that is arranged to be engaged and disengaged with and from the lock recessed portion; and an urging member arranged to urge the lock pin toward the lock recessed portion; the second shaft portion having an axial length longer than a depth of the lock recessed portion from an opening edge of the lock recessed portion to an inner bottom surface of the lock recessed portion, when the second shaft portion of the lock pin is inserted and engaged in the lock recessed portion and one side end surface of an outer circumference surface of the first shaft portion is abutted on one side end surface of an inner circumference surface of the sliding hole in a circumferential direction by a maximum relative rotation of the vane rotor in one direction, a first clearance being formed between a radial other side end surface of the outer circumference surface of the first shaft portion, and a radial other side end surface of the inner circumference surface of the sliding hole, a second clearance being formed between the other side end surface of an outer circumference of the second shaft portion, and the other side end surface of the inner circumference surface of the lock recessed portion which confronts the other side end surface of the second shaft portion, a stepped surface being formed between the outer circumference of the first shaft portion and the outer circumference of the second shaft portion, and having a stepped width in a radial direction, and a width of the second clearance being substantially identical to the width of the stepped surface.

In a more preferable aspect, the width of the stepped surface is greater than a width of the first clearance.

In a more preferable aspect, the first shaft portion and the second shaft portion are coaxial with each other.

In a more preferable aspect, one end portion of the urging member is elastically retained on an inner bottom surface of a bottomed cylindrical shape formed within the first shaft portion in an axial direction of the first shaft portion.

In a more preferable aspect, the lock recessed portion is formed into a circular hole shape.

In a more preferable aspect, the lock recessed portion includes a bottomed hole portion which is formed on the inner bottom surface of the housing main body or the plate member, and an annular member which is fixed in an inner circumference surface of the hole portion by press-fit.

In another preferable aspect, an assembling method of a valve timing control device including a housing main body which has a hollow shape, to which a rotational force is transmitted from a crank shaft, and which includes a plurality of shoes that are formed on an inner circumference of the housing main body to protrude in radially inward directions, a plate member closing an opening formed at least at one axial end of the housing main body, a vane rotor which is fixed to a cam shaft, which includes a plurality of vanes arranged to separate operation chambers formed between the plurality of the shoes, into advance angle operation chambers and retard angle operation chambers, and which is arranged to be pivoted relative to the housing main body by supply and discharge of a hydraulic pressure to and from the advance angle operation chambers and the retard angle operation chambers, a lock hole provided on the plate member on a side of the operation chamber, a sliding hole formed in a specific vane of the plurality of the vanes in an axial direction of the cam shaft, and a lock pin including a first shaft portion arranged to be slidably moved within the sliding hole, and a second shaft portion which is integrally provided to a tip end of the first shaft portion, which has a diameter smaller than a diameter of the first shaft portion, and which is arranged to be inserted and engaged in the lock hole, and thereby to restrict the vane rotor at a relative rotation position on a maximum advance angle or on a maximum retard angle with respect to the housing main body, the assembly method including: mounting the housing main body within which the vane rotor is received, on an upper surface of the plate member arranged to be freely rotated; inserting a pin corresponding jig corresponding to the lock pin, into the sliding hole of the specific vane and the lock hole of the plate member; rotating the plate member in one direction to rotate the vane rotor through the pin corresponding jig in the same one direction, to bring one side surface of the specific vane into contact with a confronting side surface of one of the shoes, and to bring an outer circumference surface of the pin corresponding jig, into contact with one side end surface of an inner circumference surface of the sliding hole; pulling out from the pin corresponding jig from the sliding hole and the lock hole; and inserting the lock pin into the sliding hole to insert and engaging the second shaft portion in the lock hole while positioning the first shaft portion to the sliding hole.

In a more preferable aspect, the pin corresponding jig has a cylindrical shape having an outside diameter substantially identical to an outside diameter of the first shaft portion of the lock pin.

In a more preferable aspect, the pin corresponding jig includes a first portion which has a cylindrical shape, which corresponds to the first shaft portion of the lock pin, and which has an outside diameter substantially identical to an outside diameter of the first shaft portion, and a second portion which has a cylindrical shape, which corresponds to the second shaft portion of the lock pin, and which has an outside diameter that is greater than an outside diameter of the second shaft portion, and smaller than the outside diameter of the first shaft portion.

In a more preferable aspect, the second shaft portion has an axial length longer than a depth of the lock recessed portion from an opening edge of the lock recessed portion to an inner bottom surface of the lock recessed portion; when the second shaft portion of the lock pin is inserted and engaged in the lock hole and a side end surface of an outer circumference surface of the first shaft portion on one side in the radial direction is abutted on the confronting end surface on the one side of the inner circumference surface of the sliding hole, in a circumferential direction of the vane rotor, by the relative rotation of the vane rotor in the one direction, a first clearance being formed between a side end surface of the outer circumference of the first shaft portion on the other side radially opposite to the side end surface of the outer circumference surface of the first shaft portion on the one side, and a confronting end surface of the inner circumference surface of the sliding hole on the other side radially opposite to the confronting end surface on the one side of the inner circumference surface of the sliding hole, and having a width A, a second clearance being formed between a side end surface of the outer circumference surface of the second shaft portion on the other side, and a confronting surface of the inner circumference surface of the lock hole which is on the other side, and which confronts the side end surface of the outer circumference surface of the second shaft portion on the other side, and having a width B, a stepped surface being formed between an outer circumference of the first shaft portion and an outer circumference of the second shaft portion, and having a radial width C, and a relationship of $B \approx C$ being satisfied.

In a more preferable aspect, a relationship between the width C of the stepped surface and the width A of the first clearance satisfies $C>A$.

The invention claimed is:

1. A valve timing control device for an internal combustion engine which is arranged to vary a relative rotational phase between a crank shaft and a cam shaft, the valve timing control device comprising:

a housing main body which includes a plurality of shoes provided on an inner circumference of the housing main body, and which has a cylindrical shape having at least one end opening located at an one end of the housing main body in an axial direction;

a plate member closing the at least one end opening of the housing main body;

a vane rotor which is fixed to the cam shaft, and which includes vanes separating portions between the plurality of shoes of the housing main body into retard angle operation chambers and advance angle operation chambers;

a lock recessed portion formed on an inner bottom surface of the housing main body or an inner side surface of the plate member;

a lock pin which is disposed within a sliding hole formed within the vane rotor in the axial direction, and which includes a first shaft portion that has a first diameter, and that is arranged to be slidably moved on an inner circumference surface of the sliding hole, and a second shaft portion that is provided to the first shaft portion, that has a second diameter smaller than the first diameter of the first shaft portion, and that is arranged to be selectively engaged with the lock recessed portion; and a coil spring arranged to urge the lock pin toward the lock recessed portion;

the second shaft portion having an axial length longer than a depth of the lock recessed portion from an opening edge of the lock recessed portion to an inner bottom surface of the lock recessed portion, in a state in which the second shaft portion of the lock pin is inserted and engaged in the lock recessed portion and a radial one side of an outer circumference surface of the first shaft portion is abutted on a radial one side of an inner circumference surface of the sliding hole in a circumferential direction of the vane rotor with one of the vanes being in contact with one of the plurality of shoes by a maximum relative rotation of the vane rotor with respect to the housing main body in one direction, a first clearance being formed between a radial other side of the outer circumference surface of the first shaft portion, and a confronting end surface of a radial other side of the inner circumference surface of the sliding hole, a second clearance being formed between an outer circumference of the second shaft portion on a side of the first clearance, and a radial other side of the inner circumference surface of the lock recessed portion, a stepped surface being formed at a connection portion between the first shaft portion and the second shaft portion, and having a stepped width in a radial direction, and a width of the second clearance being substantially identical to the width of the stepped surface.

2. The valve timing control device for the internal combustion engine as claimed in claim 1, wherein the width of the stepped surface is greater than a width of the first clearance.

3. The valve timing control device for the internal combustion engine as claimed in claim 2, wherein the first shaft portion and the second shaft portion are coaxial with each other.

4. The valve timing control device for the internal combustion engine as claimed in claim 1, wherein one end portion of the coil spring is elastically retained on an inner bottom surface of a bottomed cylindrical shape formed within the first shaft portion in an axial direction of the first shaft portion.

5. The valve timing control device for the internal combustion engine as claimed in claim 1, wherein the lock recessed portion has a circular hole shape.

6. The valve timing control device for the internal combustion engine as claimed in claim 5, wherein the lock recessed portion includes a bottomed hole portion which is formed on the inner bottom surface of the housing main body or the inner side surface of the plate member, and an annular sleeve which is press-fit in an inner circumference surface of the hole portion.

7. An assembly method of a valve timing control device for an internal combustion engine, the valve timing control device including a housing main body which has a hollow shape, to which a rotational force is transmitted from a crank shaft, and which includes a plurality of shoes that are formed on an inner circumference of the housing main body to protrude in radially inward directions, a plate member closing an opening formed at least at one axial end of the housing main body, a vane rotor which is fixed to a cam shaft, which includes vanes arranged to separate operation chambers formed between the plurality of shoes, into advance angle operation chambers and retard angle operation chambers, and which is arranged to be pivoted relative to the housing main body by supply and discharge of a hydraulic pressure to and from the advance angle operation chambers and the retard angle operation chambers, a lock hole provided on the plate member on a side of the advance angle operation chambers and the retard angle operation chambers, a sliding hole formed in the vane rotor in an axial direction of the cam shaft, and a lock pin including a first shaft portion arranged to be slidably moved within the sliding hole, and a second shaft portion which is provided to the first shaft portion, which has a diameter smaller than a diameter of the first shaft portion, and which is arranged to be inserted and engaged in the lock hole, and thereby to restrict the vane rotor at a relative rotation position on a maximum advance angle or on a maximum retard angle with respect to the housing main body, the assembly method comprising:

mounting the housing main body within which the vane rotor is received, on an upper surface of the plate member arranged to be freely rotated;

inserting a pin corresponding jig corresponding to the lock pin, into the sliding hole and the lock hole of the plate member;

rotating the plate member in one direction to rotate the vane rotor through the pin corresponding jig in the one direction, to bring one side surface of one of the vanes into contact with a confronting side surface of one shoe of the plurality of shoes, and to bring an end edge of one side of an outer circumference surface of the pin corresponding jig, into contact with a confronting end surface of one side of an inner circumference surface of the sliding hole;

pulling out from the pin corresponding jig from the sliding hole and the lock hole; and inserting the lock pin into the sliding hole to insert and engage the second shaft portion in the lock hole while positioning the first shaft portion in the sliding hole.

8. The assembling method for valve timing control device for the internal combustion engine as claimed in claim 7, wherein the pin corresponding jig has a cylindrical shape having an outside diameter substantially identical to an outside diameter of the first shaft portion of the lock pin.

9. The assembling method for valve timing control device for the internal combustion engine as claimed in claim 7, wherein the pin corresponding jig includes a first portion which has a cylindrical shape, which corresponds to the first shaft portion of the lock pin, and which has an outside diameter substantially identical to an outside diameter of the first shaft portion, and a second portion which has a cylindrical shape, which corresponds to the second shaft portion of the lock pin, and which has an outside diameter that is greater than an outside diameter of the second shaft portion, and smaller than the outside diameter of the first shaft portion.

10. The assembling method for valve timing control device for the internal combustion engine as claimed in claim 7, wherein the second shaft portion has an axial length longer than a depth of a lock recessed portion from an opening edge of the lock recessed portion to an inner bottom surface of the lock recessed portion; and in a state in which the second shaft portion of the lock pin is inserted and engaged in the lock recessed portion and an end edge on one side of an outer circumference surface of the first shaft portion is abutted on the confronting end surface on the one side of the inner circumference surface of the sliding hole, in a circumferential direction of the vane rotor, by the maximum relative rotation of the vane rotor in the one direction, a first clearance being formed between an end edge of an other side of the outer circumference surface of the first shaft portion, and a confronting end surface of an other side of the inner circumference surface of the sliding hole, and having a width A, a second clearance being formed between an end edge of an outer circumference surface of the second shaft portion on a side of the first clearance, and an end surface on an other side of an inner circumference surface of the lock recessed portion, and having a width B, a stepped surface being formed at a connection portion between the first shaft portion and the second shaft portion, and having a radial width C, and a relationship of B substantially equal to C being satisfied.

11. The assembling method for valve timing control device for the internal combustion engine as claimed in claim 7, wherein a relationship between the width C of the stepped surface and the width A of the first clearance satisfies C>A.

12. The assembling method for valve timing control device for the internal combustion engine as claimed in claim 11, wherein a third clearance is formed on a side opposite to the second clearance having width B, in a radial direction of the sliding hole; the third clearance has a width D; and a relationship between the width D and the width C of the stepped surface satisfies D>C.

13. A valve timing adjustment device arranged to vary a relative rotational phase between a crank shaft and a cam shaft, the valve timing adjustment device comprising:

a housing main body which has a cylindrical shape, and which includes a plurality of shoes provided on an inner circumference of the housing main body to protrude in radially inward directions;

a front plate and a rear plate which close axial end portions of the housing main body;

a lock recessed portion formed on the front plate or the rear plate;

a vane rotor including a rotor fixed to the cam shaft, and a plurality of vanes which are provided to the rotor, and which separate portions between the plurality of shoes;

a lock pin which is slidably disposed within a sliding hole formed in one vane of the plurality of vanes in a rotation axis direction of the vane rotor, and which includes a first shaft portion arranged to be slid on an inner circumference surface of the sliding hole, and a second shaft portion that is integrally provided to the first shaft portion, and that has a diameter smaller than a diameter of the first shaft portion;

the lock recessed portion which has a cylindrical hollow inner circumference, which is provided to the front plate or the rear plate, and which is arranged to receive the second shaft portion of the lock pin when a relative rotation position of the vane rotor and the housing main body is an endmost position in a relatively rotatable angle range, and thereby to restrict a relative rotation between the vane rotor and the housing main body; and a coil spring arranged to urge the lock pin toward the lock recessed portion, the second shaft portion having an axial length which is longer than an axial depth of the lock recessed portion, and the second shaft portion having a backlash amount within which the second shaft portion moves in a circumferential direction around the rotation axis of the vane rotor when the second shaft portion is inserted in the lock recessed portion and the one vane of the plurality of vanes is abutted on one of the plurality of shoes, and which is substantially identical to a radial length of a stepped surface formed by the first shaft portion and the second shaft portion of the lock pin.

* * * * *